US007494947B2

(12) United States Patent
Boscolo

(10) Patent No.: US 7,494,947 B2
(45) Date of Patent: Feb. 24, 2009

(54) POLYPROPYLENE-BASED HEAT-WELDABLE THERMOPLASTIC FIBERS, A METHOD OF FABRICATING SUCH FIBERS, AND A NON-WOVEN FABRIC OBTAINED BY HEAT-BONDING SUCH FIBERS

(75) Inventor: Galliano Boscolo, Nigliano BSE (IT)

(73) Assignee: ALBIS, Milan (IT)

( * ) Notice: Subject to any disclaimer, the term of this patent is extended or adjusted under 35 U.S.C. 154(b) by 514 days.

(21) Appl. No.: 10/494,238

(22) PCT Filed: Nov. 5, 2002

(86) PCT No.: PCT/EP02/12331

§ 371 (c)(1),
(2), (4) Date: May 3, 2004

(87) PCT Pub. No.: WO03/040443

PCT Pub. Date: May 15, 2003

(65) Prior Publication Data

US 2004/0248491 A1 Dec. 9, 2004

(30) Foreign Application Priority Data

Nov. 5, 2001 (FR) ..... 01 14275

(51) Int. Cl.
*D04H 1/00* (2006.01)
*B29C 47/88* (2006.01)
*C08L 23/14* (2006.01)

(52) U.S. Cl. ..... 442/361; 442/409; 428/374; 428/400; 264/211.14; 264/331.17; 152/180; 152/181; 525/240; 524/583

(58) Field of Classification Search ..... 428/400, 428/374; 525/240; 524/583; 442/361, 409; 264/211.14, 331.17; 156/180, 181
See application file for complete search history.

(56) References Cited

U.S. PATENT DOCUMENTS

| | | | | |
|---|---|---|---|---|
| 4,115,620 | A * | 9/1978 | Gupta et al. | 428/374 |
| 4,296,022 | A * | 10/1981 | Hudson | 524/349 |
| 5,888,438 | A * | 3/1999 | Gupta et al. | 264/176.1 |
| 6,116,683 | A | 9/2000 | Maier | |
| 6,116,883 | A | 9/2000 | Takeuchi et al. | 425/72.2 |

* cited by examiner

*Primary Examiner*—Fred M Teskin
(74) *Attorney, Agent, or Firm*—Weingarten, Schurgin, Gagnebin & Lebovici LLP

(57) ABSTRACT

The polypropylene-based thermoplastic fibers are uniform in cross-section, not having any degraded surface skin, and they are heat-weldable at a pressure at a temperature which is lower than the melting temperature, by virtue of internal heating due to the effect of said pressure. They are made of a first constituent with high crystallinity and at least one second constituent, compatible with the first constituent, and of crystallinity that is lower than that of the first constituent. They have a quantity of primary oxidation inhibitor lying in the range 350 ppm to 1000 ppm. Such fibers are made by spinning under conditions that avoid molecular degradation by thermal oxidation at the periphery of the fibers, in particular with cooling that is rapid immediately on leaving the extrusion head. The non-woven fabric obtained by heat-bonding such fibers is characterized by weld points that are in the form of a polymer laminate that is uniform and transparent.

26 Claims, 5 Drawing Sheets

POLYPROPYLENE-BASED HEAT-WELDABLE THERMOPLASTIC FIBERS, A METHOD OF FABRICATING SUCH FIBERS, AND A NON-WOVEN FABRIC OBTAINED BY HEAT-BONDING SUCH FIBERS

This application is a 371 national phase filing of PCT/EP02/12331 filed Nov. 5, 2002, and claims priority to a French application No. 01/14275 filed Nov. 5, 2001.

The present invention relates to polypropylene-based heat-weldable thermoplastic fibers suitable for use in manufacturing a non-woven fabric by heat-bonding, particularly in the hygienic/sanitary sector. The invention also relates to a method of fabricating such fibers, and to a non-woven fabric obtained by heat-bonding said fibers.

BACKGROUND OF THE INVENTION

Polyolefin fibers, and in particular polypropylene fibers, present particular characteristics which have contributed to their development: high chemical inertness, no polar groups, allow specific weight, low heat conductivity, good insulating power, good resistance to abrasion, little power to absorb water, good resistance to mold and to bacteria, and excellent color fastness obtained by including pigments during spinning. Such polyolefin fibers are used on their own or mixed with other fibers in the fabrication of products belonging to the textile sector proper, such as underwear, sports garments, and carpets, or indeed the industrial sector such as engineering fabrics, or filters, or indeed the hygienic/sanitary sector such as sanitary napkins. In this hygienic/sanitary sector, it is the properties of resistance to mold and bacteria, chemical inertness, and poor ability to absorb water that constitute the main advantages of polyolefin fibers, and in particular of polypropylene fibers. These fibers are considered as being non-toxic and non-cytotoxic.

Polypropylene fibers are generally produced using the molten spinning technique which consists in melting the polymer with various additives in an extruder at high temperature, and in causing the resulting molten material to pass through the holes of an extrusion head, a metering pump serving to maintain a constant pressure during this operation. The hot filaments leaving the extrusion head are cooled by a flow of air and are subjected to various operations, in particular to stretching and cutting, in order to obtain fibers having desirable cohesion and mechanical characteristics.

Non-woven fabric is fabricated from polypropylene fibers by various techniques, including heat-bonding. In this technique, the polypropylene fibers are in the form of a sheet and they are compressed while hot so as to obtain inter-fiber bonds by localized surface melting of the fibers in the bonding zones.

Until now, there have been three types of polypropylene fiber that are specially designed to be used in fabricating non-woven fabrics by the heat-bonding technique.

A first type of fiber, disclosed in particular by documents U.S. Pat. No. 4,473,677, U.S. Pat. No. 5,985,193, and WO 99/55942, comprises two-component fibers. They are obtained by using two extruders, each being fed independently with a specific polymer, the two polymers in question having melting temperatures that are slightly different. During the heat-bonding operation, it is the component that has the lower melting temperature that melts in order to provide bonding between the fibers. The drawback of that first type of fiber stems in particular from the relatively high cost of fabrication due to the fact that a special spinning installation is required for the co-extrusion.

In a second type of fiber, as disclosed in particular by documents U.S. Pat. No. 5,985,193 and WO 99/55942, the fibers are likewise two-component fibers made by a polymer mixture obtained directly from a single extruder. The structure of the fibers is irregular, with one of the components forming islands in the other component, and with the dimensions of the islands being a function of the miscibility of the two components.

In a third type of fiber, as disclosed in particular by documents U.S. Pat. No. 5,281,378, U.S. Pat. No. 5,318,735, U.S. Pat. No. 5,431,994, U.S. Pat. No. 5,709,119, U.S. Pat. No. 5,882,662, U.S. Pat. No. 5,985,193, and U.S. Pat. No. 6,116,883, the fibers present a surface skin that is degraded. Such fibers are commonly referred to as "skin" fibers. They are obtained under special conditions in the spinning and cooling process leading to molecular degradation by thermal oxidation at the periphery of the fibers, the skin being constituted by a surface layer of polymer degraded in this way. During the heat-bonding operation, cohesion between the fibers is obtained by melting of the polymer that constitutes the degraded skin, which polymer presents a melting temperature that is lower than that of the non-degraded polymer constituting the fiber core.

From the above examination of the three types of polypropylene fiber that has been specially designed for use in fabricating non-woven fabrics by heat-bonding, it can be seen that cohesion between the fibers is always obtained by means of a polymer portion situated at the surface of the fiber that presents a melting temperature lower than the melting temperature of the polymer constituting the remainder of the fiber. The polymer portion having a lower melting temperature enables inter-fiber bonds to be created in the non-woven fabric, while the remainder of the polymer which is not directly involved by the heat-bonding serves to maintain the mechanical properties of the fibers.

Concerning the costs of fabricating the three above-mentioned types of fiber, there is no doubt that degraded skin fibers are the best since they do not require a special installation for fabrication purpose, merely requiring special conditions to be implemented during spinning and cooling.

Nevertheless, degraded skin fibers present certain drawbacks. Although no clear explanation is available for this phenomenon, it is observed that degraded skin fibers are less soft to the touch, presenting a harder "handle" or "feel". This discomfort is further increased when accessing the software of a non-woven fabric obtained with such degraded skin fibers, since the inter-fiber bond zones that have been melted are themselves rigid, and are made of the degraded polymer.

Furthermore, in order to obtain a degraded skin during spinning, the Applicant has found it necessary to work under operating conditions that are precise, and thus with an operating window that is quite narrow. The difficulty of controlling such operating conditions leads to frequent variations in the quality of the non-woven fabric obtained using such fibers.

Finally, in order to obtain molecular degradation by thermal oxidation it is necessary to work at a high extrusion temperature which leads to greater energy consumption.

OBJECTS AND SUMMARY OF THE INVENTION

The object of the present invention is to propose novel polypropylene-based heat-weldable thermoplastic fibers which are suitable for fabricating non-woven fabric by heat-bonding, particularly but not exclusively in the hygienic/sanitary field, and that mitigate the above-mentioned drawbacks of the three types of polypropylene fiber that has been proposed until now.

This object is fully achieved by fibers of the present invention which, in characteristic manner, are of a structure that is uniform in cross-section, not having a degraded skin on the surface, and are heat-weldable under a given pressure and a given temperature that is lower than the melting temperature by virtue of internal heating under the effect of said pressure.

Thus, unlike the three above-mentioned types of fiber, cohesion between the fibers is not obtained by means of a polymer portion having a lower melting temperature. In the particular disposition of the invention, the fibers are completely uniform in structure throughout their cross-section, and have neither a degraded skin on the surface, nor islands, nor two distinct components. The macromolecular composition of the fibers is determined in such a manner that internal heating is produced when they are compressed under a given pressure, this internal heating enabling them to be heat-weldable under said pressure and at a given temperature which is lower than their melting temperature.

Preferably, in order to obtain this internal heating under pressure, the fibers of the invention are constituted of a first constituent of high crystallinity and at least one second constituent compatible with the first constituent and of crystallinity that is lower than that of the first constituent.

The presence of the second constituent, of lower crystallinity, constitutes a certain amount of molecular disorder in then crystalline phrase, thereby facilitating the initiation of molecular slip during compression of the fibers during the so-called "plastic" phase.

The plastic behavior of polypropylene enables it to withstand high levels of deformation, possibly as great at 600% to 700%, and to keep its shape once deformed in a manner that is relatively stable. During the compression process, the polypropylene passes through two stages, an elastic stage and a plastic stage. During the elastic stage, which corresponds to deformation less than or equal to 1%, the polypropylene cools down slightly. During the plastic stage, molecular slip occurs which propagates through the bulk of the polypropylene. The molecular friction created in this way generates the heat that raises the temperature of the fiber. Depending on the initial temperature and compression conditions, this increase in temperature can cause the polypropylene to melt.

The presence of the second constituent of lower crystallinity makes it possible to obtain this melting in almost instantaneous manner under conditions of pressure and temperature that are acceptable for a heat-bonding operation.

In a variant embodiment, the first constituent is a crystalline homopolymer of polypropylene and the second constituent is a copolymer of propylene and at least one other monomer selected from ethylene, butene, and α-olefins having a carbon chain with at least five carbon atoms.

The relative proportions by weight of the first and second constituents preferably lie in the range 20% to 99% for the first constituent and 80% to 20% for the second constituent.

Another object of the invention is to provide a method that is specially devised for fabricating the above-mentioned fibers by spinning. In characteristic manner, the method implements spinning conditions which avoid molecular degradation by thermal oxidation at the periphery of the fibers during spinning.

These special conditions include in particular the presence of a large quantity of oxidation inhibitor additive, and more particularly a primary quantity of oxidation inhibitor lying in the range 350 parts per million (ppm) to 1000 ppm.

Conventionally, when spinning polypropylene, the quantity of primary oxidation inhibitor is generally less than 350 ppm.

A primary oxidation inhibitor is an additive which protects the polymer against the action of oxygen at high temperatures. It is preferably selected from sterically hindered phenols and from lactones. Other additives are also used such as primary oxidation inhibitors which are additives for protecting the polymer at high fabrication temperatures in the absence of oxygen. These comprise in particular organic phosphite.

In fibers of the invention, it is preferable to implement both secondary oxidation inhibitors and primary oxidation inhibitors.

Other additives may also be used such as anti-acid agents selected for example from stearates, in particular calcium or zinc stearates which are used to avoid corrosion phenomena.

It is also possible to use additives for protecting the polymer at storage temperatures for long periods of time (shelf life). These additives are generally selected from phenols and sterically hindered amines.

The Applicant has found that it is essential to optimize the oxygen stability of the polymer at high temperatures by using a sufficient quantity of primary oxidation inhibitor in order to remain below the threshold at which degradation by thermal oxidation begins during spinning, thereby avoiding the formation of a degraded skin on the surface of the fiber.

Amongst the particular conditions that avoid molecular degradation by thermal oxidation on the periphery of the fibers during spinning, second conditions relate to the cooling of the fiber on leaving the extrusion head.

More particularly, cooling is performed quickly, immediately on leaving the extrusion head, e.g. by blowing a flow of air at a temperature lying in the range 16° C. to 26° C., this flow being directed directly onto the polymer spindle or bulb that forms at the outlet from the hole in the extrusion head. Advantageously, this air flow prevents relative humidity lying in the range 30% to 80%.

Another object of the invention is to provide a method of fabricating a non-woven fabric from a sheet of polypropylene-based fibers of crystal structure possessing the above-described characteristics. This method consists in heat-bonding said sheet in welding zones by compressing the fibers in these welding zones at a temperature below their melting temperature and at a pressure which is determined in such a manner as to obtain internal heating during plastic deformation of the fibers that causes them to melt in the welding zones.

It should be observed that the non-woven fabric obtained by heat-bonding fibers of the invention is characterized in that the weld points in the welding zones are in the form of a multilayer or stratified polymer, i.e. a polymer laminate. They are formed by the plastic deformation of the fibers in the welding zones and by the interpenetration and intermixing of the polymer molecules on the surfaces of said fibers during the localized melting. From the point of view of appearance, they are characterized by uniformity and by transparency. This configuration differs from that observed when heat-bonding fibers that present a degraded surface skin. In that case, the weld points comprise inter-fiber bonds in the form of filaments or membrances and they are white in appearance. It should be observed that the optical transparency of weld points can be observed only for uniform polymers of very small thickness, less than 1 micrometer (μm), without any elements of the filament type or the membrane type, and without any microbubbles of air.

This polymer laminate type configuration of the weld points makes it possible to obtain a non-woven fabric that has good strength.

When a non-woven fabric made of fibers having a degraded skin is subjected to rupture testing, it is found that rupture occurs around and outside the weld point by individual fibers breaking. In contrast, when a non-woven fabric made of fibers of the present invention is subjected to rupture testing, rupture occurs initially inside and subsequently outside the weld points, by the fibers separating, and secondly by individual fibers breaking.

In addition, the feel of the non-woven fabric that is obtained is particularly soft. This can be explained by the perfectly smooth surface state both of the fibers themselves and also of the inter-fiber bonds. It should be observed that the temperature and compression conditions during heat-bonding are such as to lead to no degradation by thermal oxidation on the surfaces of the inter-fiber bonds. Thus, the non-woven fabric obtained by the invention presents a structure that is completely uniform, both concerning the fibers from which it is made and concerning the inter-fibers bonds in the welding zones.

BRIEF DESCRIPTION OF THE DRAWINGS

The present invention, its characteristics, and the various advantages that it provides appear more clearly on reading the following description of embodiments of heat-weldable fibers of uniform structure without any degraded surface skin, and shown in the accompanying drawings, in which.

MORE DETAILED DESCRIPTION

Figure 1:
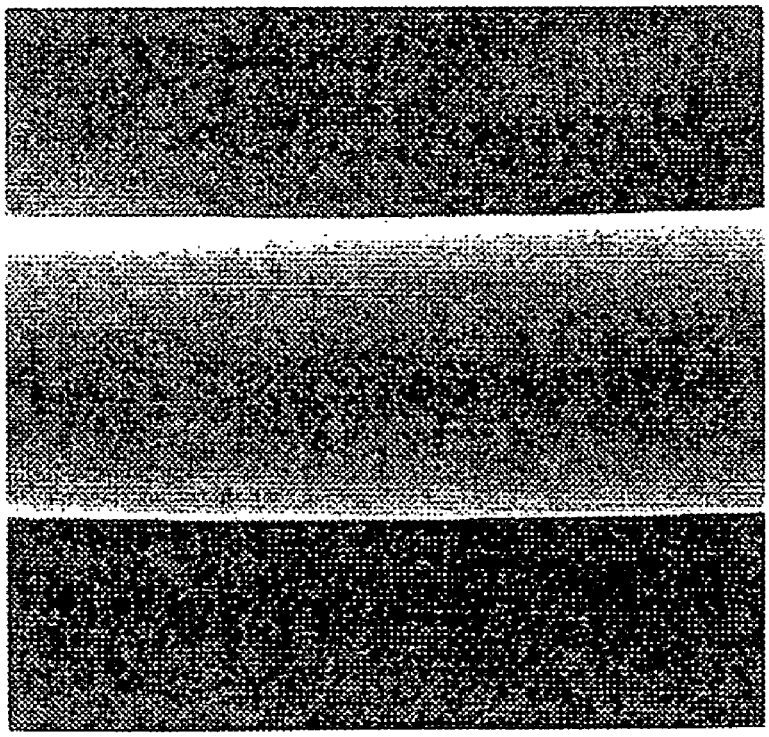
FIG. 1 is a view of the outside surface of a fiber of the invention.

Example Composition for Fibers of the Invention

Table 1 below shows the variation in the melting temperature of a blend of a polypropylene homopolymer (HP554N produced by the supplier Basell) and of a copolymer of polypropylene and of polyethylene (RCXP 2130 produced by the supplier Basell). The melting temperature is determined as being the temperature which corresponds to the melting enthalpy peak as measured by differential thermal analysis. The apparatus used was the DSC 700 manufactured by the supplier Polymer Lab. The rate of heating was 3° C. per minute (min).

TABLE 1

| Polymer | HP554N (F79S) | RCXP2130 (RP554M) | 30/0.6/0.4 blend of HP554N/RCXP21 |
|---|---|---|---|
| Melting temperature | 164.5° C. | 144.1° C. | 161.5° C. |

The melting temperature of the blend is lower than that of the polymer, which is indicative of disorder being formed at molecular scale. This disorder can be absorbed using X-rays. It can be the result either of limited displacement of certain atoms relative to the crystallographic planes, or to expansion or compression of the inter-plane distances, or to a decrease or an increase in the concentration of electronics in certain crystallographic planes. Although the Applicant seeks not to be tied to this explanation, it would appear that the plastic weldability properties of the fibers are enhanced by the third factor which comes, in the above example, from the presence of polypropylene methyl groups that modify stereographic position inside the crystal structure.

It is also possible in the invention to use a polypropylene-polyethylene copolymer of crystal structure that presents a certain amount of disorder due to the presence of segments of polyethylene chains in the crystal structure of the polypropylene. Nevertheless, fabrication of such a copolymer requires very careful control in order to confer good plasticity properties on the final material. This constraint does not apply to using the above-specified blend.

Oxidation Inhibitor Composition

The Applicant has found that the oxidation inhibitor composition added to the polymer blend is very important in avoiding the formation of a degraded skin that is harmful to the feel and to the mechanical properties of the non-woven fabric obtained from the fibers.

In the context of the present invention, the concentration of the oxidation inhibitor composition is of the order of 500 ppm to 2000 ppm.

Table 2 below gives three examples of compositions which are preferably incorporated in the polymer blend given by way of example.

Oxygen stability at high temperatures for the resulting blend is measured by the thermal oxidation stability index (TOSI) method. F. Polato: Communicazione privata, Nov. 30, 1998. This method assumes that melting flow rate (MFR) is, to a first approximation, an indicator of the mean molecular weight Mw of the polymer. It consists in evaluating the molecular degradation of the polymer maintained at a constant temperature in a closed cell for a defined length of time, in the absence of oxygen, and in extruding it several times at high temperature in the presence of oxygen in the air.

TABLE 2

| Oxidation inhibitor composition | A MFR | B MFR2 | C MIL2 |
|---|---|---|---|
| 1 | 8.50 | 116.90 | 153.83 |
| 2 | 8.50 | 28.22 | 66.90 |
| 3 | 8.50 | 62.80 | 143.20 |

A: The original MFR of the polymer as determined using the ASTM D-1238 standard (condition L: 230/2016).

B: MFR2 is measured using the ASTM D 1238 standard at 290° C. for 18 minutes without oxygen.

C: MIL 2 is the MFR of the polymer determined using the ASTM D 1238 standard (condition L; 230/2.16) after being heated twice to 290° for 6 min in the presence of oxygen.

Composition 1

Total concentration: 500 ppm.

Sterically hindered phenol selected from C.A.S. Nos. 6683-19-8, 27676-62-6, and 2082-79-3/photo stabilizer/organic phosphites selected form C.A.S. Nos. 31570-04-4 and 119345-01-6.

Composition 2

Total concentration: 1200 ppm.

Lactone C.A.S. Nos. 18131-48-7/photo stabilizer: sterically hindered amine/organic phosphites selected from C.A.S. Nos. 31570-04-4, 119345-01-6.

Composition 3

Total concentration: 750 ppm.

Sterically hindered phenol selected from C.A.S. Nos. 6683-19-8, 27676-62-6, and 2082-79-3/organic phosphites selected from C.A.S. Nos. 31570-04-4 and 119345-01-6. 500 ppm of calcium stearate was added to all of the above compositions.

Method of Fabricating the Fiber

In order to avoid any degradation by thermal oxidation at the outlet from the extrusion head, a cooling apparatus was used implementing flows of air directed towards the bundles or segments leaving the extrusion head, thereby reducing the time during which the hot fiber is in contact with the oxygen of the ambient atmosphere, and also increasing the stability of the column of molten polymer.

Figure 2:
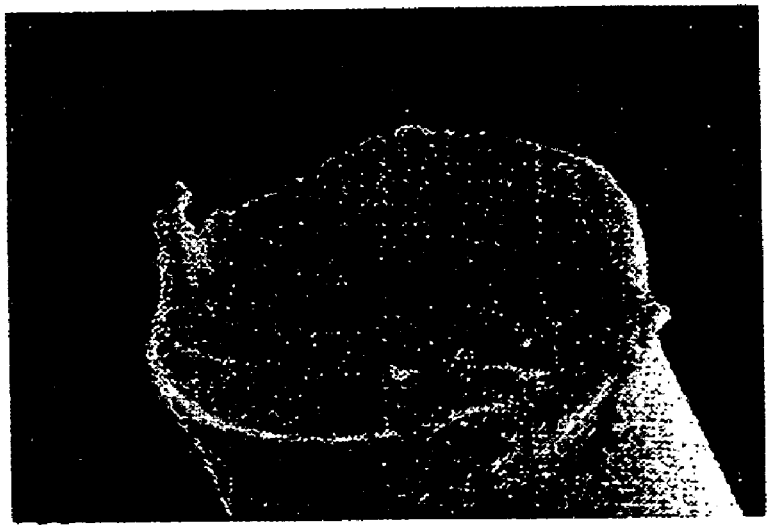
FIG. 2 is a cross-section view of the FIG. 1 fiber.

FIG. 1 shows clearly that the surface of the fiber obtained by the method of the invention is perfectly smooth, and FIG. 2 shows clearly that in cross-section the fiber is perfectly uniform. Its cross-section does not reveal any ring structure.

Figure 3:
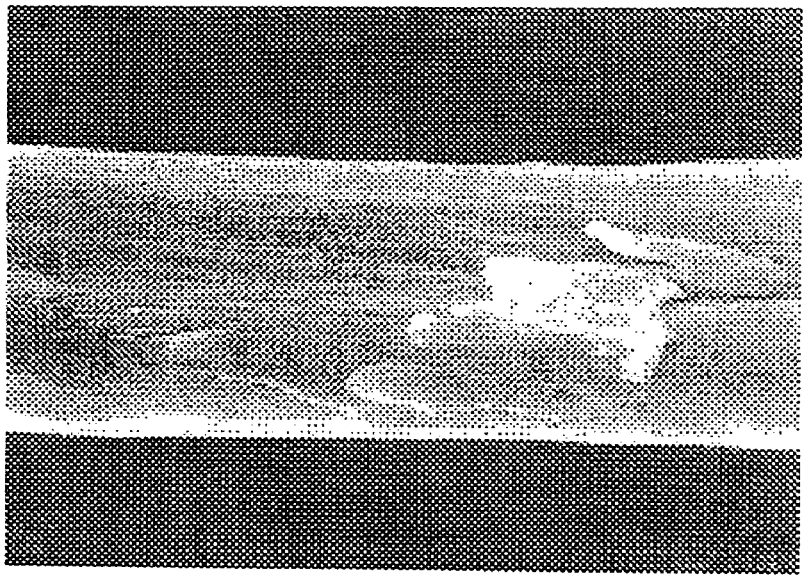
FIG. 3 is a view of the outside surface of a fiber having a core-and-skin structure.
Figure 4:
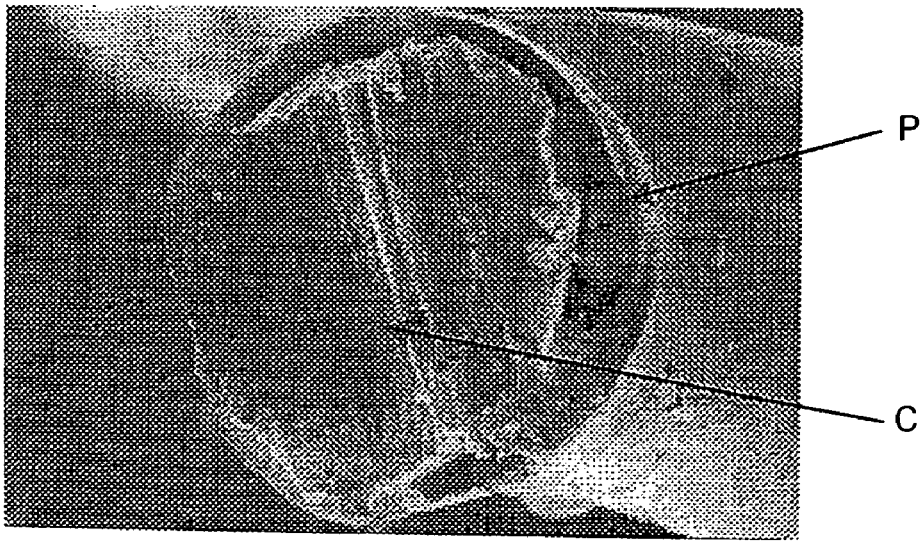
FIG. 4 is a cross section view of the FIG. 3 fiber.

In comparison, FIG. 3 shows that the outside surface of a fiber of core-and-skin structure is irregular. In cross-section (FIG. 4) there can be seen an outer skin referenced P and a core referenced C that is surrounded by the skin.

FIGS. 5 to 9 show an embodiment of apparatus enabling the method of the invention for fabricating a fiber to be implemented.

Figure 5:
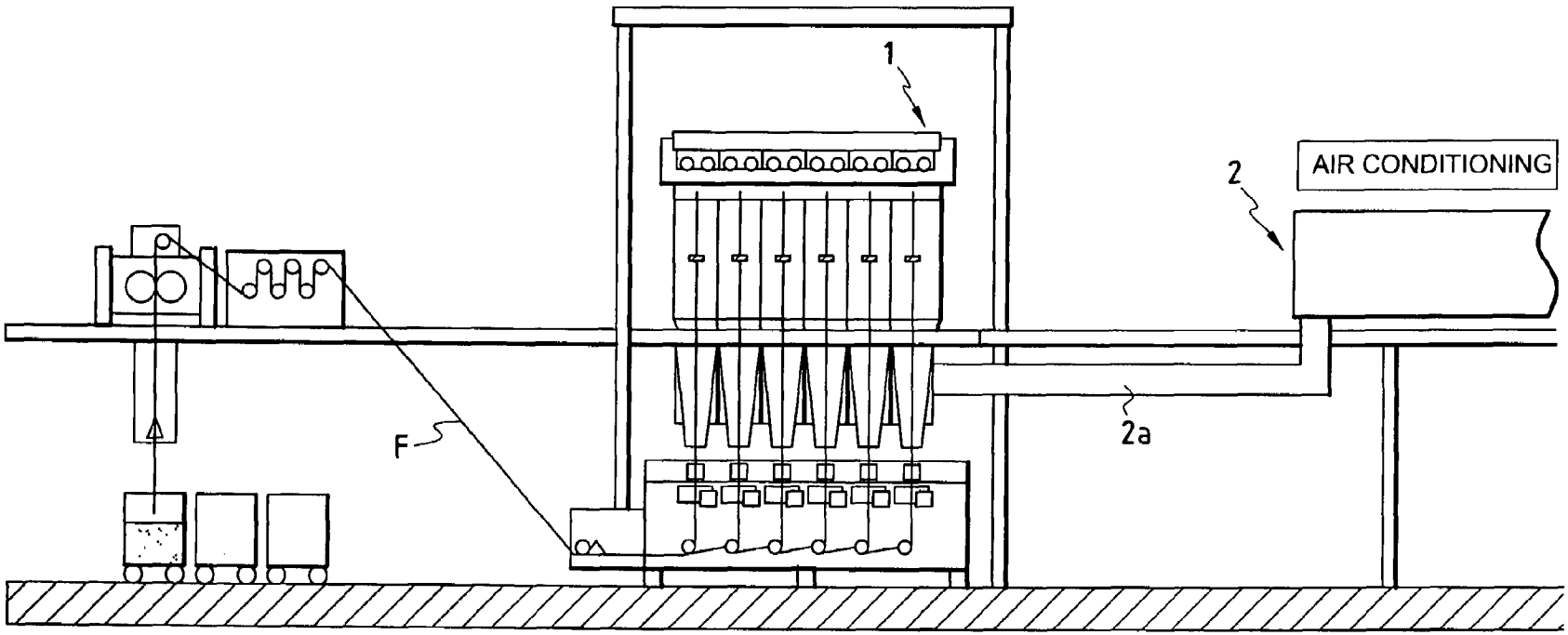
FIG. 5 is a diagram of apparatus enabling the method of the invention to be implemented.
Figure 7:
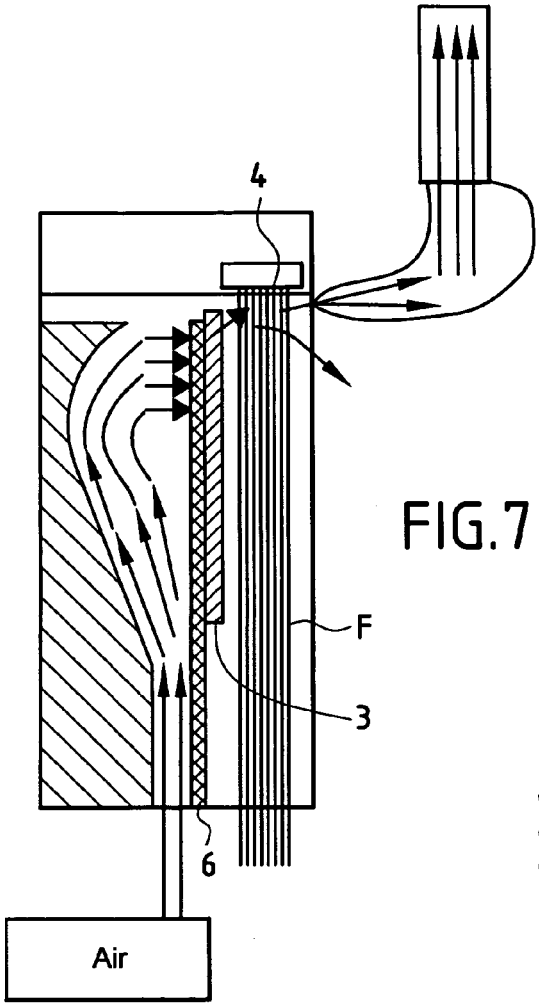
FIG. 7 is a section view of FIG. 6.
Figure 8:
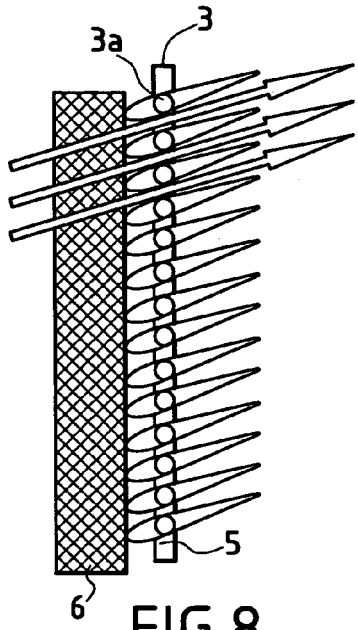
FIGS. 8 and 9 are more detailed views of the steerable fins of the cooling system.
Figure 6:
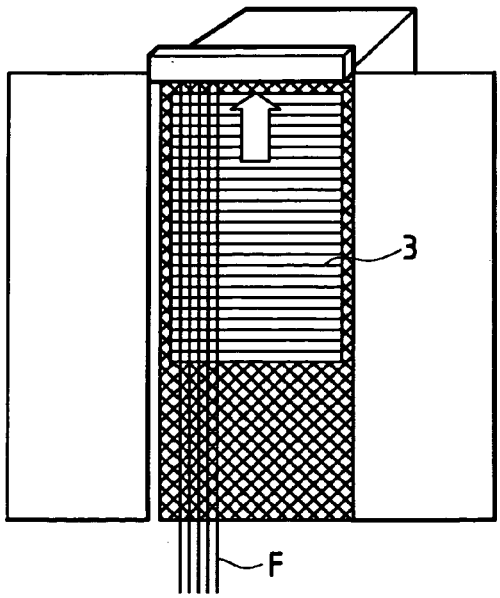
FIG. 6 is an enlarged front view of the cooling zone of the FIG. 5 apparatus.

FIG. 5 shows an extrusion head 1 fitted with an air cooling system 2. Air arrives via a tube 2*a* placed beneath the extrusion head. With reference to FIG. 6, the fibers F that are extruded pass in front of fins 3 which are described below in greater detail with reference to FIGS. 8 and 9. With reference to FIG. 7, the cooling air is directed through filters 6 at the extrusion head 4. The flow of air is directed by means of the fins 3. After passing over the fibers F, the heated air is exhausted. With reference to FIG. 8, the air is represented by arrows passing between the fins 3 which are steerably mounted on a frame 5. Each fin 3 is mounted to pivot about a pivot 3*a* relative to the frame 5.

Figure 9:
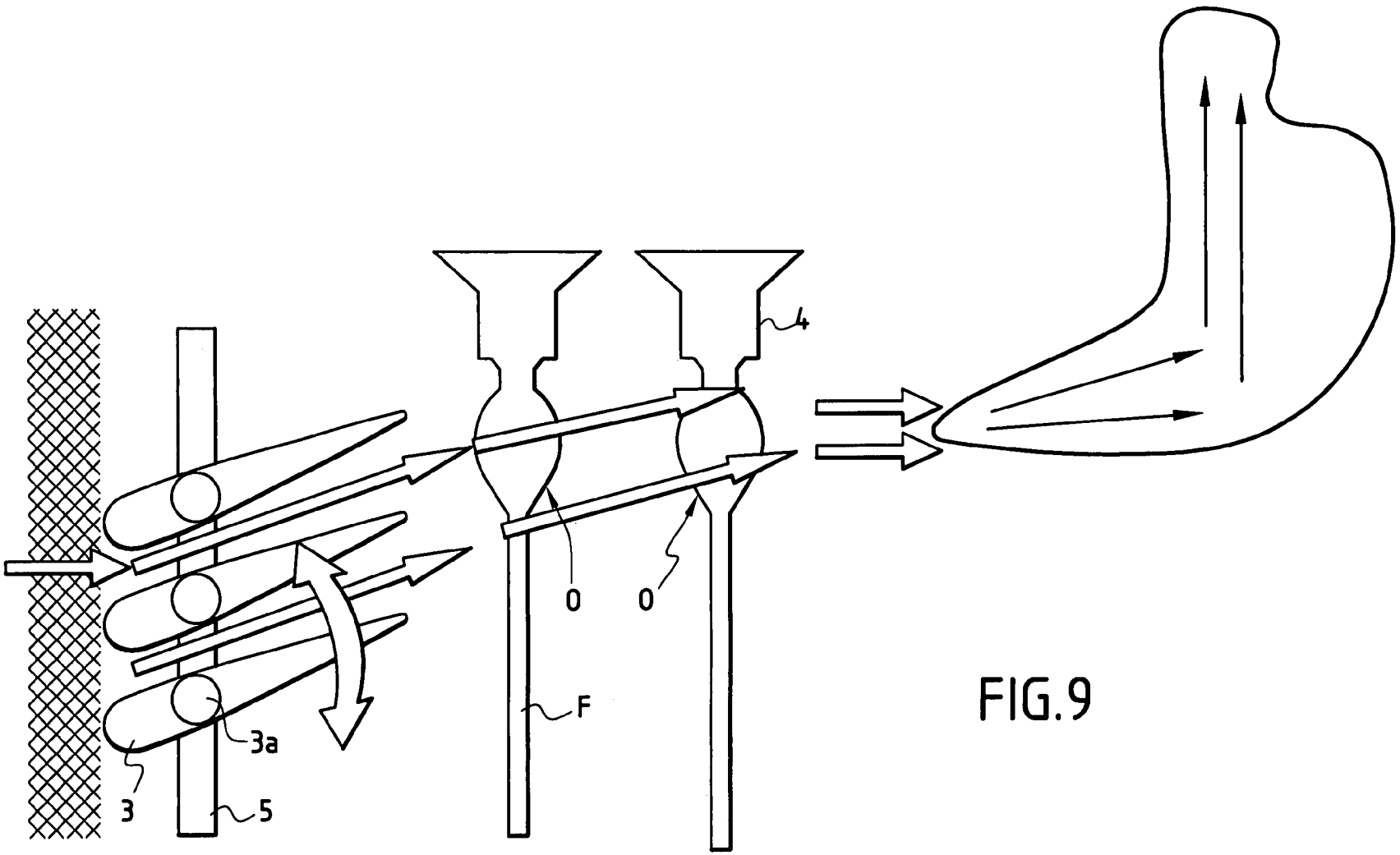

With reference to FIG. 9, the cooling air represented by arrows is directed by means of the fins 3 so as to cool the bulb of polymer O that forms at the extrusion head 4. The heated air is then evacuated.

In a particular embodiment, the cooling air is at a temperature lying in the range 16° C. to 26° C. and presents relative humidity lying in the range 30% to 80%.

Method of Fabricating a Non-Woven Fabric

In the method of the invention, the sheet of fibers is raised to a temperature lower than the softening temperature of the polymer material constituting said fibers and it is strongly compressed in certain zones so as to cause the above-described creep phenomenon to occur in those fibers that are situated in said zones (initiation and propagation of molecular slip). During the plastic stage of fiber deformation under the effect of the compression, the fibers heat up internally, thereby raising their temperature to the melting temperature. This melting in combination with the compression leads to weld points being created having a polymer laminate structure that is uniform and transparent. The temperature to which the fibers are heated is about 140° C. to 145° C. for a period of 10 milliseconds (ms) which corresponds to the length of time the fibers are in contact with the compression rollers in the heat-bonding installation. The pressure applied is determined so as to obtain maximum cohesion in the resulting non-woven fabric.

The invention claimed is:

1. Polypropylene-based heat-weldable monocomponent thermoplastic fibers usable for fabricating non-woven fabric by heat-bonding, the fibers being uniform in cross-section, not having a degraded surface skin, and being heat-weldable under a given temperature and a given pressure at which the fibers weld below their melting temperature by virtue of internal heating under the effect of said pressure, wherein the fibers are made from a blend comprising first and second constituents of different crystallinity, wherein the crystallinity of the second constituent is lower than that of the first constituent.

2. Fibers according to claim 1, wherein the first constituent is a crystalline homopolymer of polypropylene, and the second constituent is a copolymer of propylene and at least one other monomer selected from: ethylene; butene; and α-olefins having a carbon chain with at least five carbon atoms.

3. Fibers according to claim 1, wherein the relative proportions by weight of the first and second constituents are 20% to 99% for the first constituent and 80% to 1% for the second constituent.

4. Fibers according to claim 1, further comprising a primary oxidation inhibitor, the quantity of said primary oxidation inhibitor lying in the range 350 ppm to 1000 ppm.

5. A method of fabricating polypropylene-based fibers according to claim 1 comprising the step of:

spinning, characterized by conditions that avoid molecular degradation by thermal oxidation at the periphery of the fibers during spinning.

6. A method according to claim 5, wherein said conditions comprising the presence of a quantity of primary oxidation inhibitor lying in the range 350 ppm to 1000 ppm.

7. A method according to claim 5, wherein the fibers are produced by extrusion through an extrusion head, and said conditions include rapid cooling immediately on leaving the extrusion head.

8. A method according to claim 7, wherein the rapid cooling is obtained by blowing a flow of air at a temperature lying in the range 16° C. to 26° C., the flow being directed directly onto the spindle (or bulb) of polymer that forms at the outlet from the extrusion head.

9. A method of fabricating a non-woven fabric from a sheet of polypropylene-based fibers according to claim 1, comprising the step of:

heat-bonding said sheet in welding zones by compressing said fibers in said zones at a temperature lower than their melting temperature, and at a given pressure that is sufficient, during plastic deformation of the fibers, to obtain internal heating causing the fibers to melt in the welding zones.

10. A non-woven fabric obtained by heat-bonding polypropylene-based fibers according to claim 1, wherein the heat-bonding takes place in welding zones and results in the formation of weld points in said welding zones, and wherein the weld points in the welding zones are in the form of a polymer laminate that is uniform and transparent.

11. The non-woven fabric of claim 10, wherein, when it is subjected to rupture testing, ruptures takes place initially inside the weld points, and subsequently outside the weld points.

12. Polypropylene-based heat-weldable monocmoponent thermoplastic fibers usable for fabricating non-woven fabric by heat bonding, the fibers being uniform in cross-section, not having a degraded surface skin, wherein the fibers are made from a blend comprising first and second constituents of different crystallinity, wherein the crystallinity of the second constituent is lower than that of the first constituent.

13. Fibers according to claim 12, wherein the first constituent is a crystalline homopolymer of polypropylene, and the second constituent is a copolymer of propylene and at least one other monomer selected from: ethylene; butene; and α-olefins having a carbon chain with at least five carbon atoms.

14. Fibers according to claim 12, wherein the relative proportions by weight of the first and the second constituents are 20% to 99% for the first constituent and 80% to 1% for the second constituent.

15. Fibers according to claim 12, further comprising a primary oxidation inhibitor, the quantity of said primary oxidation inhibitor lying in the range 350 ppm to 1000 ppm.

16. Fibers according to claim 13, wherein the relative proportions by weight of the first and the second constituents are 20% to 99% for the first constituent and 80% to 1% for the second constituent.

17. Fibers according to claim 13, further comprising a primary oxidation inhibitor, the quantity of said primary oxidation inhibitor lying in the range 350 ppm to 1000 ppm.

18. Polypropylene-based heat-weldable monocmoponent thermoplastic fibers usable for fabricating non-woven fabric by heat-bonding, the fibers being uniform in cross-section, not having a degraded surface skin, and being heat-weldable under a given temperature and a given pressure at which the fibers weld below their melting temperature by virtue of internal heating under the effect of said pressure, wherein the fibers are made from a blend comprising first and second constituents of different crystallinity, wherein the first constituent is a crystalline homopolymer of polypropylene, and the second constituent is a copolymer of propylene and at least one other monomer selected from: ethylene; butene; and α-olefins having a carbon chain with at least five carbon atoms.

19. Fibers according to claim 18, wherein the crystallinity of the second constituent is lower than that of the first constituent.

20. Fibers according to claim 18, wherein the relative proportions by weight of the first and the second constituents are 20% to 99% for the first constituent and 80% to 1% for the second constituent.

21. Fibers according to claim 18, further comprising a primary oxidation inhibitor, the quantity of said primary oxidation inhibitor lying in the range 350 ppm to 1000 ppm.

22. Fibers according to claim 19, wherein the relative proportions by weight of the first and the second constituents are 20% to 99% for the first constituent and 80% to 1% for the second constituent.

23. Fibers according to claim 19, further comprising a primary oxidation inhibitor, the quantity of said primary oxidation inhibitor lying in the range 350 ppm to 1000 ppm.

24. Fibers according to claim 2, wherein the relative proportions by weight of the first and second constituents are 20% to 99% for the first constituent and 80% to 1% for the second constituent.

25. Fibers according to claim 2, further comprising a primary oxidation inhibitor, the quantity of said primary oxidation inhibitor lying in the range 350 ppm to 1000 ppm.

26. Polypropylene-based heat-weldable monocmoponent thermoplastic fibers usable for fabricating non-woven fabric by heat-bonding, the fibers being uniform in cross-section, not having a degraded surface skin, wherein the fibers are made from a blend comprising first and second constituents of different crystallinity, wherein the first constituent is a crystalline homopolymer of polypropylene, and the second constituent is a copolymer of propylene and at least one other monomer selected from: ethylene; butene, and α-olefins having a carbon chain with at least five carbon atoms.

* * * * *

UNITED STATES PATENT AND TRADEMARK OFFICE

CERTIFICATE OF CORRECTION

PATENT NO. : 7,494,947 B2
APPLICATION NO. : 10/494238
DATED : February 24, 2009
INVENTOR(S) : Galliano Boscolo It is certified that error appears in the above-identified patent and that said Letters Patent is hereby corrected as shown below:

On the title page, item (73), "Milan" should read --Milano--;

Column 1, line 23, "allow" should read --low--;

Column 3, line 31, "phrase" should read --phase--;

Column 4, line 63, "membrances" should read --membranes--; and

Column 10, line 34, claim 6, "monocmoponent" should read --monocomponent--.

Signed and Sealed this

Tenth Day of November, 2009

David J. Kappos

David J. Kappos
*Director of the United States Patent and Trademark Office*